United States Patent [19]

LaRue et al.

[11] 4,380,202

[45] Apr. 19, 1983

[54] MIXER FOR DUAL REGISTER BURNER

[75] Inventors: Albert D. LaRue, Uniontown, Ohio; John J. Wolf, Havertown, Pa.

[73] Assignee: The Babcock & Wilcox Company, New Orleans, La.

[21] Appl. No.: 224,985

[22] Filed: Jan. 14, 1981

[51] Int. Cl.[3] ..... F23D 1/00

[52] U.S. Cl. ..... 110/263; 110/347; 239/461; 239/500

[58] Field of Search ..... 110/264, 263, 265, 347; 239/461, 500, 523

[56] References Cited

U.S. PATENT DOCUMENTS

| | | | |
|---|---|---|---|
| 554,327 | 2/1896 | Wegener | 110/264 |
| 3,788,796 | 1/1974 | Krippene et al. | 431/2 |
| 4,147,116 | 4/1979 | Graybill | 110/264 X |
| 4,223,615 | 9/1980 | Breen et al. | 110/264 |

FOREIGN PATENT DOCUMENTS

| | | | |
|---|---|---|---|
| 342294 | 1/1931 | United Kingdom . | |
| 380864 | 9/1932 | United Kingdom | 110/264 |

*Primary Examiner*—Edward G. Favors

*Attorney, Agent, or Firm*—Robert J. Edwards; J. Henry Muetterties

[57] ABSTRACT

An improved pulverized fuel burning method and apparatus having means for decreasing the pressure drop through the burner nozzle and decreasing the formation of nitric oxides, including a splash plate to breakup a natural forming fuel-rope, a deflector to deflect the fuel-rope, and a diffuser to disperse the pulverized fuel into a more desirable fuel burning distribution pattern.

7 Claims, 4 Drawing Figures

MIXER FOR DUAL REGISTER BURNER

BACKGROUND OF THE INVENTION

1. Field of the Invention

The present invention relates to fuel burners and more particularly to an improved pulverized fuel burner for reducing the pressure loss through the burner nozzle by efficiently breaking up, deflecting, and dispersing fuel ropes, defined subsequently, and for reducing the formation of nitric oxides by improving the fuel/air mixture in the burner nozzle.

The relatively high pressure loss of the primary air through the burner nozzle is an economic concern, since it increases the operating costs of the fossil fuel fired steam generating unit. This increase in operating cost is usually charged against the initial cost of the plant during bid evaluation. For this reason, it is advantageous to reduce the pressure drop in the burner nozzle as much as possible, thus minimizing the power requirements of the primary air fan.

One of the primary causes of large pressure losses in the burner nozzle is related to dispersion of fuel roping. Fuel roping is the concentration of the pulverized fuel in a relatively small area of the fuel transport pipe. Fuel roping is caused by the centrifugal flow patterns established by elbows and pipe bends. Fuel roping is unavoidable since a transition must be made from a vertical pipe run to a horizontal pipe run at the burner level.

The pressure drop in normal fluid flow and pneumatic conveying of solids in a burner nozzle can be separated into at least four effective forces:

(1) The friction of the fluid against the pipe wall.

(2) The inertia force acting on the fluid.

(3) The inertia and gravity forces acting on the solids.

(4) The aerodynamic drag force acting on the solids.

In addition, there is a pressure drop that should be taken into account; the pressure drop caused by areas of flow separation. It has been determined that in a burner nozzle venturi with particle flow, a large area of flow separation exists in the diverging outlet section, thereby increasing the pressure drop in the burner nozzle and the operating costs.

When fuel roping occurs air flow distribution has a secondary effect on particle distribution. Once a particle attains momentum in a certain direction, it will change its direction of travel primarily by being impacted with a solid surface. Therefore, drag forces between the air and solid particles are of secondary importance while the momentum (mass) of the particle is of primary importance.

It is apparent from the foregoing discussion that a reduction in the pressure drop through the burner nozzle can be accomplished by a reduction in any of the four forces that contribute to a pressure drop and an elimination of flow separation. However, any attempt to reduce pressure losses must ensure adequate air-fuel mixing in order to provide flame stability and meet acceptable low NOx standards.

One source of atmospheric pollution is the nitrogen oxides (NOx) present in the stack emission of fossil fuel fired steam generating units. Nitric oxide (NO) is an invisible, relatively harmless gas. However, as it passes through the vapor generator and comes into contact with oxygen, it reacts to form nitrogen dioxide ($NO_2$) or other oxides of nitrogen collectively referred to as nitric oxides. Nitrogen dioxide is a yellow-brown gas which, in sufficient concentrations is toxic to animal and plant life. It is this gas which may create the visible haze at the stack discharge of a vapor generator.

Nitric oxide is formed as a result of the reaction of nitrogen and oxygen and may be thermal nitric oxide and/or fuel nitric oxide. The former occurs from the reaction of the nitrogen and oxygen contained in the air supplied for the combustion of a fossil fuel whereas the latter results from the reaction of the nitrogen contained in the fuel with the oxygen in the combustion air.

The rate at which thermal nitric oxide is formed is dependent upon any or a combination of the following variables; (1) flame temperature, (2) residence time of the combustion gases in the high temperature zone and (3) excess oxygen supply. The rate of formation of nitric oxide increases as flame temperature increases. However, the reaction takes time and a mixture of nitrogen and oxygen at a given temperature for a very short time may produce less nitric oxide than the same mixture at a lower temperature, but for a longer period of time. In vapor generators of the type hereunder discussion wherein the combustion of fuel and air may generate flame temperatures in the order of 3,700° F., the time-temperature relationship governing the reaction is such that at flame temperatures below 2,900° F. no appreciable nitric oxide (NO) is produced, whereas above 2,900° F. the rate of reaction increases rapidly.

The rate at which fuel nitric oxide is formed is principally dependent on the oxygen supply in the ignition zone and no appreciable nitric oxide is produced under a reducing atmosphere; that is, a condition where the level of oxygen in the ignition zone is below that required for a complete burning of the fuel.

It is apparent from the foregoing discussion that the formation of thermal nitric oxide can be reduced by reducing flame temperatures in any degree and will be minimized with a flame temperature at or below 2,900° F. and that the formation of fuel nitric oxide will be inhibited by reducing the rate of oxygen introduction to the flame, i.e., air/fuel mixing.

However, reductions in flame temperature and the mixing of air and fuel also tend to reduce flame stability. Flame stability is essential for safe, efficient operation. Therefore, flame stability becomes a limiting factor to NOx reductions achievable by flame temperature and mixing reductions.

A pulverized fuel requires more excess air for satisfactory combustion than other fuels such as gas or oil. One reason is the inherent maldistribution of the fuel both to individual burner pipes and to the fuel discharge nozzles. Normally complete combustion of a pulverized fuel requires at least 15% excess air. Proper fuel and air mixing will decrease the need for excess air, result in the reduction of nitric oxide formation, and provide flame stability.

2. Description of the Prior Art

In the past some burner nozzles included a venturi section which was meant to break up fuel roping and evenly disperse the pulverized fuel at the outlet end of the burner nozzle. However, any attempt to reduce the pressure drop resulted in an unacceptable increase in the formation of NOx and inadequate flame stability, due to the improper mixing of the fuel and air.

U.S. Pat. No. 3,788,796 (Krippene, et al) shows a pulverized fuel burner including a venturi section and a conical end-shaped rod member. The purpose of this combination is to vary the velocity of the coal-air mixture and to enhance the fuel-air distribution. This particular design is ineffective in reducing the pressure drop through the burner nozzle.

SUMMARY OF THE INVENTION

The present invention provides an improved method and apparatus for reducing the pressure loss through the burner nozzle and for reducing the formation of nitric oxide while achieving a more complete burning of pulverized fuel than has heretofore been possible.

Accordingly, an improvement is made on pulverized fuel burners of the type disclosed in U.S. Pat. No. 3,788,796 by providing an arrangement wherein at least a part of the fuel burning apparatus is disposed within a windbox to which a portion of the necessary combustion air is supplied and which is formed between the adjacently disposed burner and furnace walls of a vapor generating unit. The burner wall is formed with an access opening for admitting that portion of the fuel burning apparatus which normally resides in the windbox whereas the furnace wall is formed with a burner port which accommodates the combining of fuel and air into a combustible mixture and the ignition thereof. The fuel burning apparatus includes a tubular nozzle which is concentrically disposed about the central axis of the burner and has its outlet end opening adjacent the burner port and its inlet end extending through the burner wall and terminating outside of the windbox. The inlet end is flow connected to an elbow pipe. The nozzle serves to convey air entrained pulverized fuel for discharge through the burner port into the combustion chamber of the vapor generating unit. A deflector shaped similar to the upper half of a frusto-conical form is mounted on the top half of and angled downward from the inlet end of the tubular nozzle. The deflector creates a converging section within the nozzle which is in flow communication with the elbow pipe. A diffuser having a plug and a shroud member is located within the nozzle. The oblong-diamond shaped plug has ascending and descending sections. The cylindrical shroud is mounted to the inside of the tubular nozzle. The nozzle and shroud cooperate to form the outer annular fuel and air flow passageway therebetween. The shroud and the plug cooperate to form a central annular fuel and air flow passageway therebetween. The central annular fuel and air flow passageway has a converging inlet and a diverging outlet section. Support means are provided to support and position the diffuser shroud co-axially with the diffuser plug such that the diffuser shroud encircles the diffuser plug.

An object of the invention is to reduce the pressure drop within the tubular nozzle in order to decrease the power requirement of the primary air fan.

Another object of the invention is to eliminate and break up fuel roping by impacting the fuel rope against a solid surface and thereafter to provide a circumferential particle distribution exiting the tubular nozzle.

A final object of the invention is to provide a pulverized fuel burning apparatus wherein the initial burning of fuel is conducted with limited turbulence to produce a stable, controlled diffusion flame with combustion completed in the furnace. The limited turbulence and delayed combustion reduces the oxygen availability and peak flame temperature which minimizes the formation of thermal nitric oxide.

DESCRIPTION OF THE PREFERRED EMBODIMENT OF THE INVENTION

Figure 1:
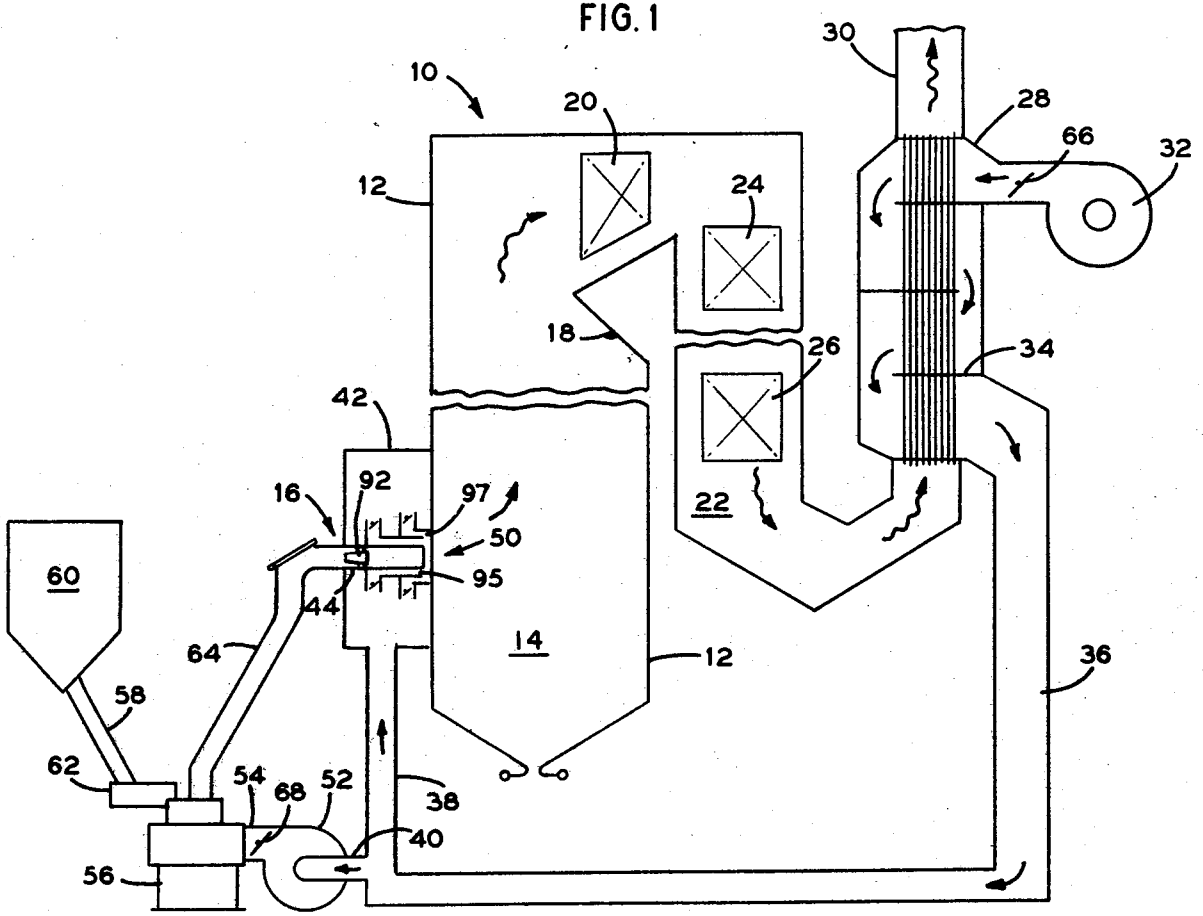
FIG. 1 is a schematic sectional elevation view of a vapor generator using fuel burning apparatus embodying the invention.

Referring to FIG. 1 there is shown a vapor generator 10 including water cooled walls 12 which define a furnace chamber or combustion space 14 to which a coal and air mixture is supplied by a pulverized fuel burner 16. After combustion has been completed in the furnace chamber 14, the heated gases flow upwardly around the nose portion 18, over the tubular secondary superheater 20, and thence downwardly through the convection pass 22 containing the tubular primary superheater 24 and the economizer 26. The gases leaving the convection pass 22 flow through tubes of an air heater 28 and are thereafter discharged through a stack 30. It will be understood that the heated gases passing over the superheaters 20 and 24 and the economizer 26 give up heat to the fluid flowing therethrough and that the gases passing through the air heater 28 give up additional heat to the combustion air flowing over the tubes. A forced draft fan 32 supplies combustion air to the vapor generator and causes it to flow over the air heater tubes and around a plurality of baffles 34 and thence through a duct 36 for apportionment between branch ducts 38 and 40 respectively.

The air passing through duct 38 is delivered into a windbox 42 and represents a major portion of the air necessary for combustion of the fuel being discharged from the nozzle 44 associated with the fuel burner 16. The windbox air is apportioned between an inner annular passageway 95 and an outer annular passageway 97 for discharge through a burner port 50 and into the furnace 14.

The air passing through duct 40 is the remaining portion of air necessary for combustion and is delivered into a primary air fan 52 wherein it is further pressurized and thereafter conveyed through a duct 54 into an air-swept type pulverizing apparatus 56.

The fuel to be burned in the vapor generator 10 is delivered in raw form via pipe 58 from the raw fuel storage bunker 60 to a feeder 62 in response to the load demand on the vapor generator 10 in a manner well known in the art. The pulverizer 56 grinds the raw fuel to the desired particle size. The pressurized air from primary air fan 52 sweeps through the pulverizer 56 carrying therewith the ground fuel particles for flow through a pipe 64 and thence to the burner nozzle 44 for discharge through the port 50 into furnace 14.

A damper 66 is associated with the forced draft fan 32 to regulate the total quantity of air being admitted to the vapor generating unit 10 in response to the load demand. A damper 68 is associated with the primary air fan 52 to regulate the quantity of air being introduced through the burner nozzle 44.

It will be appreciated that for the sake of clarity the drawings depict one fuel burner associated with one pulverizer wherein in actual practice there may be more than one burner associated with a pulverizer and there may be more than one pulverizer associated with the vapor generating unit.

Figure 2:
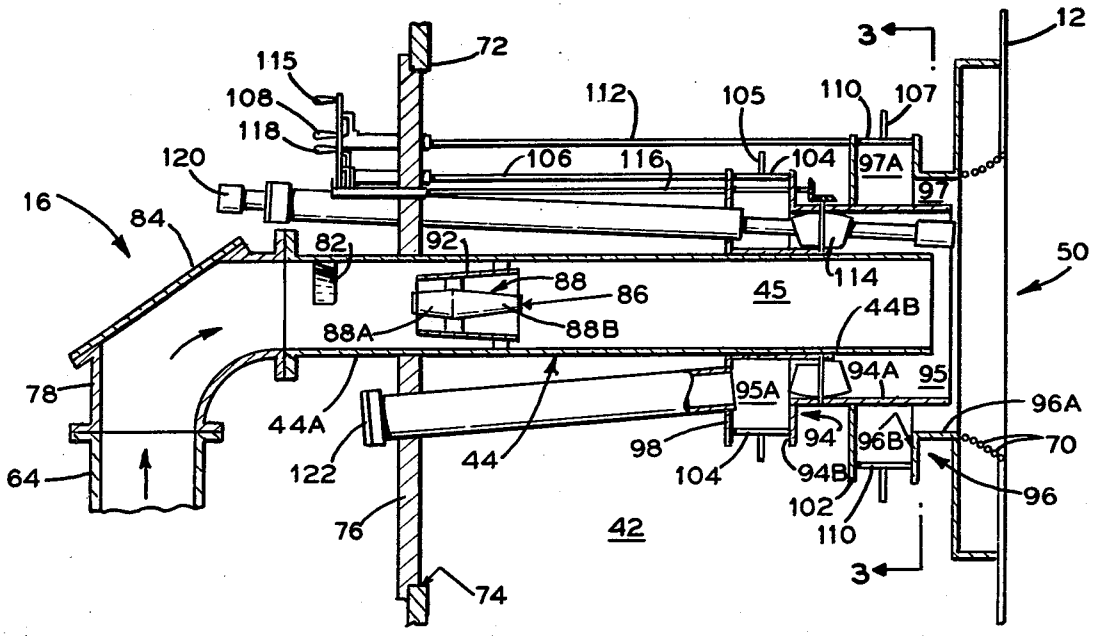
FIG. 2 is a sectional elevation view of the pulverized fuel burner embodying the invention.
Figure 4:
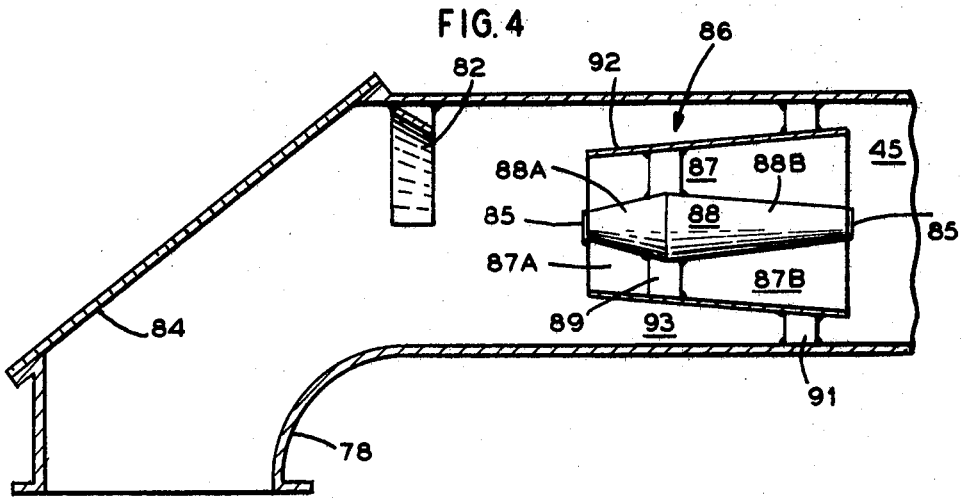
FIG. 4 is a sectional elevation view showing the mixer.

Referring to FIG. 2 and FIG. 4 there is shown the pulverized fuel burner 16 arranged to fire through the burner port 50, the latter being formed as a frusto-conical throat diverging toward the furnace side of wall 12 and being fluid cooled by the tubes 70. An outer burner wall 72 having an access opening 74 is spaced from the furnace wall 12. The space between the burner and furnace walls forms the windbox 42.

The pulverized coal burner 16 includes the tubular nozzle 44 having an inlet and outlet portions 44A and 44B respectively. The nozzle 44 defines a fuel transport passageway 45 and extends through the access opening over plate 76, across the windbox 42 to a point adjacent the burner port 50. An elbow member 78 is flow connected to the nozzle inlet portion 44A and at the other end to the fuel burner pipe 64. Elbow member 78 includes splash plate (end plate) 84 on its outside radius.

In accordance with the invention there is shown a semicircular deflector 82, shaped similar to the upper half of a frusto conical form, disposed within the fuel transport passageway 45 and mounted within the inlet end 44A of the tubular nozzle 44. The deflector 82 is angled downward from the inlet end 44A and is positioned to direct the flow of air entrained pulverized fuel to a diffuser 86 located on the longitudinal axis of the nozzle 44. Deflector 82 forms a converging section within nozzle 44.

Diffuser 86 has a plug and a shroud member, 88 and 92 respectively. The oblong-diamond shaped plug 88 is located on the axis of the burner nozzle 44 and has ascending and descending sections, 88A and 88B respectively. The ends of the plug are covered with removal caps 85 closing off the passageway through the plug, however, when preferred the caps 85 can be removed to allow an ignitor or oil burner 120A to be located along the burner axis. The frusto-conical shroud 92 is mounted to the inside of the tubular nozzle, co-axially with the plug 88 and in a surrounding relation thereto. Alternatively the shroud can be cylindrical. The nozzle 44 and the shroud 92 cooperate to form the outer annular fuel and air flow passageway 93. The shroud 92 and the plug 88 cooperate to form a central annular fuel and air flow passageway 87 therebetween. The central annular fuel air flow passageway 87 has a converging and diverging section, 87A and 87B respectively. The outer annular fuel and air flow passageway 93 and the central annular fuel and air flow passageway 87, jointly define the fuel flow area of the nozzle as the air entrained fuel passes the diffuser 86.

A plurality of equally spaced shroud supports 91 rigidly fix the shroud 92 to the nozzle 44. A plurality of equally spaced plug supports 89 rigidly fix the plug 88 to the inside of shroud 92. The plug supports 89 are located at the point where the ascending and descending section of plug 88 meet. Both the shroud supports 91 and the plug supports are shaped to minimize the flow resistance to the air entrained pulverized fuel.

A first and second sleeve member 94 and 96, respectively, are disposed within the windbox 42 to direct combustion air to the throat section formed within burner port 50. The first sleeve member 94 has a portion 94A concentrically spaced about the outlet portion 44B of nozzle 44 to form an inner annular passageway 95 therebetween. The remaining portion of sleeve 94 is in the form of a flange plate 94B extending laterally outward from the inlet end of portion 94A. An annular wall plate 98 encircles the nozzle portion 44B and is connected thereto. The plates 94B and 98 are spaced from one another to form the inlet 95A to passageway 95 which extends normal thereto. The second sleeve member 96 has a portion 96A concentrically spaced about the outlet end of sleeve portion 94A to form an outer annular passageway 97 therebetween. The remaining portion of sleeve 96 is in the form of a flange plate 96B extending laterally outward from the inlet end of portion 96A. An annular wall plate 102 encircles the sleeve portion 94A and is connected thereto.

A plurality of dampers or registers 104 are located within the inlet 95A to passageway 95 and are circumferentially and equidistantly spaced and pivotally connected between and adjacent the outer periphery of the plates 94B and 98. The dampers 104 are adapted to pivot between open, closed and intermediate positions and are preferably interconnected through a linkage train 105 so as to be collectively and simultaneously adjustable through a shaft member 106 operatively connected thereto and terminating outside of the windbox 42 and connected to a manually operated handle 108.

A plurality of dampers or registers 110 are located within the inlet 97A to passageway 97 and are circumferentially and equidistantly spaced and pivotally connected between and adjacent the outer periphery of the plates 96B and 102. The dampers 110 are adapted to pivot between open, closed and intermediate positions and are preferably interconnected through a linkage train 107 so as to be collectively and simultaneously adjustable through a shaft member 112 operatively connected thereto and terminating outside of the windbox 42 and connected to a manually operated handle 115.

A plurality of vanes 114 are located within the passageway 95. The vanes 114 are equidistantly spaced and preferably linked to one another so as to be collectively and simultaneously adjustable through a shaft member 116 operatively connected thereto and terminating outside of the windbox 42 and connected to a manually operated handle 118.

If desired, the shaft members 106, 112, and 116 may be suitably geared or otherwise connected to an operating means (not shown) which would be responsive to an automatic control.

An optional ignitor assembly 120 of known type extends through cover plate 76 and through the back plate 98 and terminates at the discharge end of annular space 95. The ignitor assembly 120A can alternatively be positioned on the longitudinal axis of nozzle 44. When the ignitor 120A is so located, the ends of plug 88 are uncapped to allow the ignitor 120A to closely fit within the exposed bore.

An observation tube 122 extends through the cover plate 76 and through back plate 98 and terminates adjacent to the inside of back plate 98.

Figure 3:
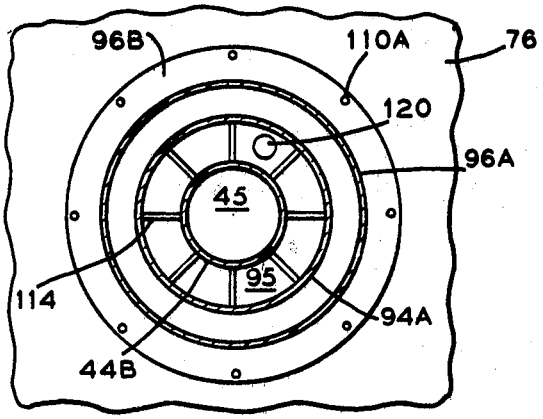
FIG. 3 is a transverse cross-sectional view taken along line 3—3 of FIG. 2.

FIG. 3 shows a fragmented portion of the windbox side of cover plate 76 and includes the flange plate 96B with the pivots 110A of the dampers 110 extending therethrough. The sleeve portions 96A and 94A cooperate with one another to form the outer annular passageway 97 therebetween and the nozzle 44B portion and sleeve portion 94A cooperate to form the inner annular passageway 95 therebetween, which houses vanes 114 therein. The tubular nozzle 44B defines the outlet portion of the fuel transport passageway 45.

The ignitor or oil burner (FIG. 2) can be located on the central axis of the burner nozzle 44. When the ignitor or oil burner 120A is located as such the plug 88 can be rigidly mounted to the ignitor or oil burner 120A.

In the operation of the preferred embodiment, the fuel to be burned in the furnace 14 is delivered in raw form via pipe 58 from the raw fuel storage bunker 60 to the pulverizer feeder 62, which regulates the quantity of fuel supplied to the pulverizer 56 in response to the load demand on the vapor generator 10 in a manner well known in the art. The pulverizer 56, being of the air-swept type, is supplied with pressurized combustion air from a primary air fan 52, the quantity of the air supplied being regulated by a damper device 68 to provide sufficient air to initiate ignition at the burner discharge and provide adequate flow velocity to insure a thorough sweeping of the pulverizer 56, fuel burner pipe 64 and nozzle 44. The deflector 82 is mounted to the inlet end of the nozzle 44 to deflect the incoming pulverized fuel into the diffuser. The diffuser plug 88 and shroud 92 cooperate to disperse the fuel into a fuel-rich circumferential distribution pattern, thus reducing the pressure drop through the nozzle by breaking up fuel roping and enhancing fuel-air distribution from nozzle 44.

Experimentation has shown that the lowest pressure loss is obtained when the deflector and diffuser have certain dimensions in comparison to the diameter (D) of the nozzle 44. The overall length of the nozzle should exceed 4.0 D and be less than 10.0 D. A 180° (semi-circular) deflector mounted on the top half of the nozzle 44 and extends horizontally preferably 0.28 D into the nozzle 44 from the point of attachment of the elbow 78 to the nozzle 44. The preferred angle of the deflector 82 is 30° from the horizontal (top of the nozzle).

The diffuser's shroud 92 and plug 88 are aligned on the longitudinal axis of the nozzle 44 and preferably at a distance of 0.8 D from the point of attachment of the elbow 78 to the nozzle 44. The overall length of each is preferably 0.72 D. The inside diameter of the inlet end of the frusto-conical shroud is 0.58 D. A shroud with a diverging 5° angle is preferred, however, a cylindrical shroud can be used. The cylindrical oblong-diamond shaped plug 88 has a maximum diameter of 0.35 D at the point where its ascending and descending sections meet, 88A and 88B respectively. The ascending section 88A has a slope approximately twice that of the descending section's 88B; preferred values are $22\frac{1}{2}°$ and $11\frac{1}{4}°$ respectively. The bore within the plug has a diameter of 3 inches (7.62 cm).

The total air required for combustion is delivered to the vapor generator by a forced draft fan 32 including a damper device 66 which regulates the quantity of air in response to the load demand on the vapor generator 10 in a manner well known in the art. The combustion air is heated as it comes into indirect contact with the flue gases flowing through the tubes of an air heater 28 and is thereafter conveyed through a duct 36 to be apportioned between ducts 40 and 38, the former leads to the pulverizer 56 as aforedescribed and the latter leads to the windbox 42 whence the air is apportioned between the inner and outer passageways 95 and 97 respectively.

From the foregoing, it will be noted that three separate flow paths are provided for admitting combustion air to the burner port 50; the central flow path through the fuel transport passageway 45 of nozzle 44, the inner annular passageway 95, and the outer annular passageway 97, both from windbox 42. The decreased pressure drop through burner nozzle and the improved fuel-air distribution constitute major features of the present invention.

While in accordance with provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed and defined as follows:

1. An improved fuel burner having a tubular nozzle with an end plate attached thereto and a means for reducing the pressure loss though the nozzle and inhibiting the formation of nitric oxides, the means comprising; a deflector located downstream fuel flow-wise of the end plate and;

a diffuser disposed within said nozzle having a shroud and a plug located downstream fuel flow-wise of the deflector.

2. The improved fuel burner according to claim 1 wherein said deflector is a semicircular plate.

3. The improved fuel burner according to claim 1 wherein said deflector is angled downward in the direction of said diffuser.

4. The improved fuel burner according to claim 1 wherein the plug is formed of two frusto-conical sections joined at their base.

5. The improved fuel burner according to claim 1 wherein the shroud is cyclindrically shaped.

6. An improved air entrained fuel burner having a tubular nozzle flow connected to an elbow member and a means for reducing the pressure loss through the nozzle, the means comprising; a deflector located downstream fuel-wise of the elbow member, and a diffuser having a cyclindrically shaped shroud mounted concentrically within the nozzle downstream fuel flow-wise of the deflector and a plug mounted concentrically within the shroud.

7. The fuel burner according to claim 6 wherein the deflector is shaped to directionally guide the air entrained fuel into the shroud.

* * * * *